US005378117A

United States Patent [19]

Bennitt

[11] Patent Number: 5,378,117

[45] Date of Patent: Jan. 3, 1995

[54] VALVE UNLOADING MEANS, AND A VALVE UNLOADING ACTUATOR THEREFOR

[75] Inventor: Robert A. Bennitt, Painted Post, N.Y.

[73] Assignee: Dresser-Rand Company, Corning, N.Y.

[21] Appl. No.: 218,404

[22] Filed: Mar. 28, 1994

[51] Int. Cl.[6] ..... F04B 49/00

[52] U.S. Cl. ..... 417/298; 417/524; 137/522; 251/63.6

[58] Field of Search ..... 417/298, 523, 524; 137/522; 251/63.5, 63.6

[56] References Cited

U.S. PATENT DOCUMENTS

| | | | |
|---|---|---|---|
| 2,037,140 | 4/1936 | Nathan | 417/298 |
| 2,626,100 | 1/1953 | McIntyre | 417/298 |
| 2,991,924 | 7/1961 | Ramsay | 417/298 |
| 3,000,319 | 9/1961 | Tuck | 417/298 |
| 5,011,383 | 4/1991 | Bennitt | 417/524 |
| 5,025,830 | 6/1991 | Kursar | 137/522 |

FOREIGN PATENT DOCUMENTS

| | | | |
|---|---|---|---|
| 0475931 | 3/1992 | European Pat. Off. | 137/522 |
| 0147284 | 5/1962 | U.S.S.R. | 417/298 |

*Primary Examiner*—Richard A. Bertsch
*Assistant Examiner*—M. Kocharov
*Attorney, Agent, or Firm*—Bernard J. Murphy

[57] ABSTRACT

A cylindrical gas compressor has inlet valves confined therewithin, at opposite ends thereof, and discharge valves, shaft-mounted therebetween, for reciprocation to ingest and compress admitted gas. Outboard of the inlet valves are circular plates from which extend a plurality of fingers. The plates are confined within chambers in the compressor, and radial ports are provided for admitting pressured fluid to the plates to cause them to move inboard, whereby the fingers penetrate the inlet valves and remove the inlet valve valving elements off the valve seat, effecting unloading of the inlet valves. Springs hold the plates outboard of the inlet valves, to allow the valves to function normally-loaded, in the absence of the plate-displacing, ports-admitted, pressured fluid.

10 Claims, 2 Drawing Sheets

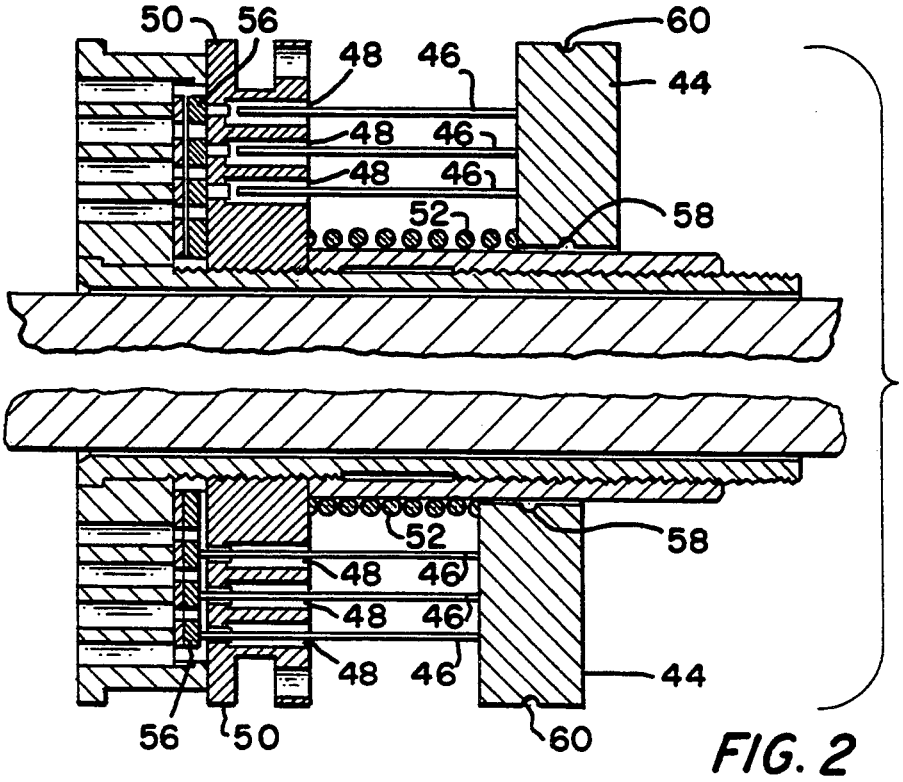
FIG. 2
FIG. 3
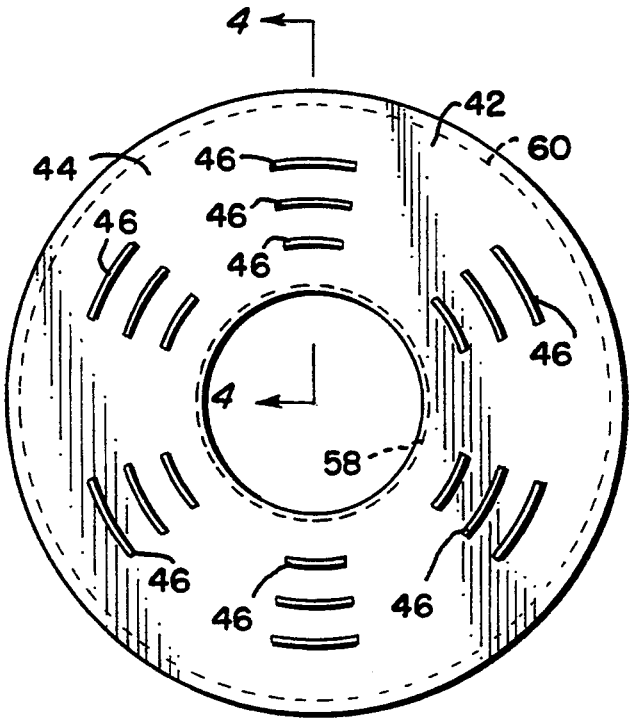
FIG. 4
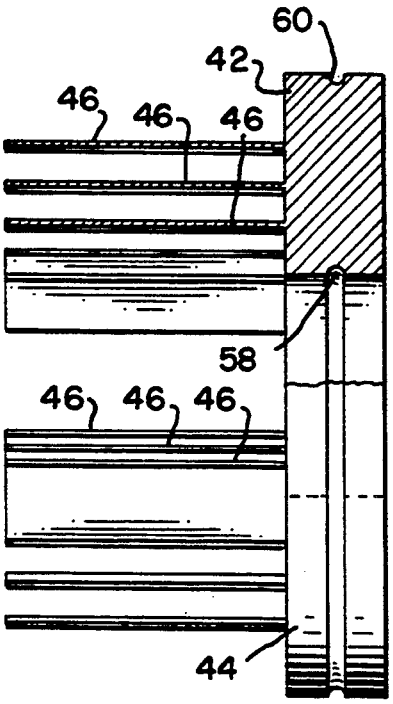

VALVE UNLOADING MEANS, AND A VALVE UNLOADING ACTUATOR THEREFOR

This invention pertains to means for unloading gas compressor valves, and to valve unloading actuators therefor, and in particular to such aforesaid means which is wholly confined within the compressor cylinder and such an actuator of unique structure.

Prior art, gas compressor unloading means, typically, comprise some considerable structures and components externally fastened to the compressor cylinder to effect a displacement of the internal, valving element. Such are reasonably efficient, but require substantial expense in manufacture and maintenance, and are somewhat complex. Commonly, they have a drive shaft which is subject to sticking or snagging. Too, for being external of the compressor cylinder they are susceptible to damage. Further, they can suffer gas leakage.

It is an object of this invention to set forth a novel valve unloading means, for a compressor, which is met with none of the aforesaid problems and disadvantages, and an actuator therefor.

Particularly, it is an object of this invention to set forth, in a gas compressor having (a) a straight cylinder, (b) inlet and discharge valves confined within said cylinder, (c) means for admitting gas into, and discharging gas from said cylinder, and (d) means for reciprocating said discharge valves to compress gas within said cylinder, means for unloading at least one of said inlet valves, comprising a platform slidably confined within said cylinder; a plurality of fingers projecting from said platform; and porting means, formed in said cylinder, for admitting pressured fluid into said cylinder to cause a slidable displacement of said platform.

It is also an object of this invention to disclose, in a gas compressor having (a) a straight cylinder, (b) inlet and discharge valves confined within said cylinder, (c) means for admitting gas into, and discharging gas from said cylinder, and (d) means for reciprocating said discharge valves to compress gas within said cylinder, means confined within said cylinder for unloading at least one of said inlet valves, comprising a platform slidably confined within said cylinder; a plurality of fingers projecting, perpendicularly, from said platform; and means formed in said cylinder for admitting a pressured fluid into said cylinder, and to said platform, to cause a pressured-fluid-actuated displacement of said platform.

Yet another object of this invention is to set forth, for use within a valve unloading means, a valve unloader actuator, comprising a plate having opposite surfaces; and a plurality of fingers projecting, perpendicularly, from one of said surfaces.

Further objects of the invention, as well as the novel features thereof, will be apparent from the following description, taken in conjunction with the accompanying figures, in which:

FIG. 2 is a cross-sectional view, in reduced scale as compared to FIG. 1, of just an inlet valve and the unloader actuator, showing the valve in a loaded disposition, and in an unloaded disposition;

FIG. 3 is a front view of the actuator, according to an embodiment thereof; and FIG. 4 is a side elevational view, with a partly cross-sectioned portion taken from section 4—4 of FIG. 3, of the actuator embodiment.

Figure 1:
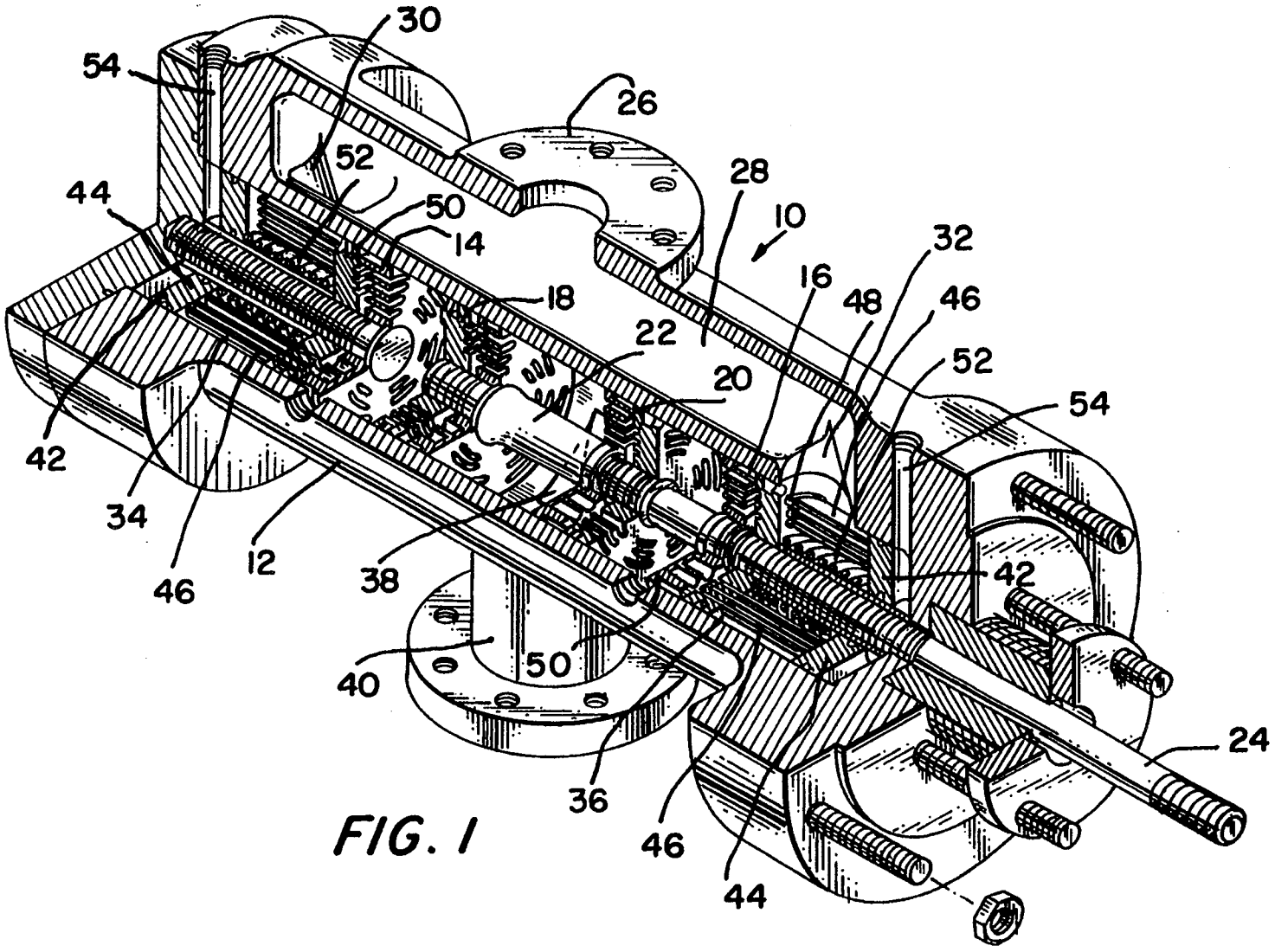
FIG. 1 is a perspective view, axially cross-sectioned through a quarter sector thereof, of a gas compressor which incorporates an embodiment of the invention.

FIG. 1 discloses a cylindrical gas compressor 10 of a type disclosed in the applicant's prior U.S. Pat. Nos. 5,011,383; 5,015,158; and 5,141,413, and said patents are incorporated herein by reference for a background understanding of the nature of the invention. The patented compressors comprise straight, cylinders with inlet valves mounted therewithin, inlet conduits for admitting gas thereinto, an outlet conduit for discharging compressed gas therefrom, and reciprocable discharge valves, piston-ringed, which serve to control the discharge of the compressed gas and as pistons for compressing the gas, the discharge valves, also of course, being confined within the cylinder. Compressor 10 comprises a cylindrical housing 12. Inlet valves 14 and 16 are mounted within the housing 12, and discharge valves 18 and 20 are supported on a reciprocable shaft 22; an extending, outer end 24 of the latter is engagable with a prime mover (not shown) for effecting reciprocation of the shaft 22 and the discharge valves 18 and 20. Atop the housing 12 is an apertured flange 26 which admits gas into an axially-extended compartment 28 formed within the housing 12. Ports 30 and 32 conduct the admitted gas to inlet chambers 34 and 36 which are walled, inwardly thereof, by the inlet valves 14 and 16. With reciprocation, the discharge valves 18 and 20, alternately, ingest the admitted gas and compress the same, and then discharge the compressed gas through a discharge port 38, located midway along the housing 12, and a discharge conduit 40 which is aligned with the port 38. The aforesaid compressor functioning is similarly, and with somewhat more detail, described in the cited, prior patents.

The valves, inlet valves 14 and 16, and discharge valves 18 and 20, are of the well-known, plate type. In this, each has a valve seat, a valve guard, and a valving element movable therebetween. Too, the seat, guard and valving element of each have arcuate channels formed therein which, depending upon the disposition of the valving element permit gas to flow therethrough, or prevent such gas flow.

The invention comprehends means for penetrating such aforesaid channels, positively to displace the valving element, to effect unloading of the compressor 10. Such means take the form of valve unloading actuators 42 which are arranged in the chambers 34 and 36. Each actuator 42 comprises a circular plate 44 which serves as a platform for a plurality of fingers 46; FIGS. 3 and 4 clearly disclose the structure of the actuators 42. The fingers 46, of arcuate cross-section, extend from the plate 44, perpendicularly. They penetrate the channels 48 in the valve seats 50 of the inlet valves 14 and 16. Compression springs 52, interposed between the plates 44 and valves 14 and 16, urge the plates 44 outwardly so that the fingers 46 will not extend fully through the channels. In such a disposition, then, the valves 14 and 16 function normally, and the compressor 10 can operate loaded. To cause the actuators 42 to unload the compressor 10, the bias of the springs 52 has to be overcome. Provision for this is provided. Adjacent each axial end of the compressor 10 are formed radial ports 54. These are arranged to open outboard of the plates 44 within the housing 12. Consequently, it remains only to admit a pressured fluid into the ports 54, and into the chambers 34 and 36, for pressured displacement of the plates 44 against the spring biasing. In such circumstances, the fingers 46 penetrate fully through the channels 48 in the valve seats 50. They engage the valving element and hold it removed from the valve seat.

The valving elements 56 (not shown in FIG. 1) are shown in FIG. 2. Herein it can be seen, in the top half of the illustration, that the valving element 56 is not reached by the fingers 46. However, in the bottom half of FIG. 2, the fingers have penetrated fully through the inlet valve seat 50, have engaged the valving element 56 and hold it off of the seat 50. Consequently, the valve remains open, and the compressor can run unloaded. As evidenced in FIGS. 2, 3 and 4, the plates 44 have annular recesses 58 and 60, formed in the inner and outer peripheral surfaces thereof to fluid-seal thereacross with O-ring seals (not shown) accommodated in the recesses.

As can be appreciated, the invention provides the compressor with means for an easier, unloaded, start-up, and with relevant pressure control of the pressured fluid which is introduced into the radial ports 54, the invention can function as a capacity control. Clearly, with all the mechanism of the actuators 42 confined within the housing 12, they are protected from inadvertent damage. Too, the housing confinement of the actuators 42 minimizes the potential for gas leakage. The invention requires a remarkable minimum of parts and, of course, it presents no problem of a misaligned and stuck drive shaft, as it has none.

While I have described my invention in connection with an embodiment thereof, it is to be clearly understood that this is done only by way of example, and not as a limitation to the scope of the invention as set forth in the objects thereof and in the appended claims.

I claim:

1. In a gas compressor having (a) a straight cylinder, (b) inlet and discharge valves confined within said cylinder, (c) means for admitting gas into, and discharging gas from said cylinder, and (d) means for reciprocating said discharge valves to compress gas within said cylinder, means for unloading at least one of said inlet valves, comprising:

a platform slidably confined within said cylinder;

a plurality of fingers projecting from said platform; and porting means, formed in said cylinder, for admitting a pressured fluid into said cylinder to cause a slidable displacement of said platform.

2. Unloading means, according to claim 1, further including:

biasing means, interposed between said platform and said one inlet valve, for urging said platform in a given, slidable direction.

3. Unloading means, according to claim 1, wherein:

said one inlet valve has a plurality of throughgoing, arcuate channels formed therein;

said fingers are of arcuate cross-section; and said fingers are in penetration of said channels.

4. Unloading means, according to claim 3, wherein:

said one inlet valve has a valve seat, a valve guard, and a valving element movable between said seat and guard; and said channels are formed in said valve seat.

5. Unloading means, according to claim 1, wherein:

said gas admitting means comprises a chamber formed within said cylinder, and means for conducting gas into said chamber; and said platform is slidable within said chamber.

6. In a gas compressor having (a) a straight cylinder, (b) inlet and discharge valves confined within said cylinder, (c) means for admitting gas into, and discharging gas from said cylinder, and (d) means for reciprocating said discharge valves to compress gas within said cylinder, means confined within said cylinder for unloading at least one of said inlet valves, comprising:

a platform slidably confined within said cylinder;

a plurality of fingers projecting, perpendicularly, from said platform; and means formed in said cylinder for admitting a pressured fluid into said cylinder, and to said platform, to cause a pressured-fluid-actuated slidable displacement of said platform.

7. Unloading means, according to claim 6, wherein:

said platform is slidable within said cylinder in first and second, opposite directions; and further including means interposed between said platform and said one inlet valve, for urging said platform in one of said first and second directions.

8. Unloading means, according to claim 6, wherein:

said one inlet valve has a plurality of throughgoing, arcuate channels formed therein;

said fingers are of arcuate cross-section; and said fingers are in penetration of said channels.

9. Unloading means, according to claim 8, wherein:

said one inlet valve has a valve seat, a valve guard, and a valving element movable between said seat and said guard; and said channels are formed in said valve seat.

10. Unloading means, according to claim 6, wherein:

said gas admitting means comprises a chamber formed within said cylinder, and means for admitting gas into said chamber; and said platform is slidable within said chamber.

* * * * *